US007975753B2

(12) United States Patent
Lehman et al.

(10) Patent No.: US 7,975,753 B2
(45) Date of Patent: Jul. 12, 2011

(54) METHOD AND APPARATUS FOR CONTROLLING THE FLOW OF MOLTEN STEEL IN A MOULD

(75) Inventors: Anders Lehman, Bromma (SE); Helmut Hackl, Vasteras (SE); Jan-Erik Eriksson, Vasteras (SE); Olof Sjoden, Nykoping (SE)

(73) Assignee: ABB AB (SE)

( * ) Notice: Subject to any disclaimer, the term of this patent is extended or adjusted under 35 U.S.C. 154(b) by 194 days.

(21) Appl. No.: 12/349,335

(22) Filed: Jan. 6, 2009

(65) Prior Publication Data

US 2009/0120604 A1 May 14, 2009

Related U.S. Application Data

(63) Continuation of application No. PCT/SE2007/050489, filed on Jul. 3, 2007.

(60) Provisional application No. 60/818,527, filed on Jul. 6, 2006.

(51) Int. Cl.
*B22D 11/00* (2006.01)
*B22D 27/02* (2006.01)

(52) U.S. Cl. ..... 164/466; 164/468; 164/502; 164/504

(58) Field of Classification Search ..... 164/466, 164/468, 502, 504
See application file for complete search history.

(56) References Cited

U.S. PATENT DOCUMENTS

| | | | | |
|---|---|---|---|---|
| 7,540,317 | B2 * | 6/2009 | Kubota et al. | 164/466 |
| 2005/0039876 | A1 * | 2/2005 | Eriksson | 164/466 |

FOREIGN PATENT DOCUMENTS

| | | | |
|---|---|---|---|
| EP | 1 486 274 | A1 * | 12/2004 |
| EP | 1486274 | A1 | 12/2004 |
| JP | 05329594 | A1 | 12/1993 |
| JP | 09108797 | A | 4/1997 |
| JP | 09262651 | A | 10/1997 |
| JP | 2000158108 | A | 6/2000 |
| JP | 2000351048 | A | 12/2000 |
| JP | 2001047195 | | 2/2001 |

OTHER PUBLICATIONS

International Search Report and Written Opinion, Oct. 31, 2007, 11 pages.

* cited by examiner

*Primary Examiner* — Kevin P Kerns
(74) *Attorney, Agent, or Firm* — St. Onge Steward Johnston & Reens LLC

(57) ABSTRACT

Method for controlling a flow of molten steel in a mould by applying at least one magnetic field to the molten steel in a continuous slab casting machine. Controlling a molten steel flow velocity on a molten steel bath surface to a predetermined molten steel flow velocity by applying a static magnetic field to impart a stabilizing and braking force to a discharge flow from an immersion nozzle when the molten steel flow velocity on the meniscus is higher than a mould powder entrainment critical flow velocity. Controlling the molten steel flow velocity on the meniscus to a range of from an inclusion adherence critical flow velocity or more to a mould powder entrainment critical flow velocity or less by applying a shifting magnetic field to increase the molten steel flow when the molten steel flow velocity on the meniscus is lower than the inclusion-adherence critical flow velocity.

18 Claims, 3 Drawing Sheets

METHOD AND APPARATUS FOR CONTROLLING THE FLOW OF MOLTEN STEEL IN A MOULD

CROSS-REFERENCE TO RELATED APPLICATIONS

The present application is a continuation of pending International patent application PCT/SE2007/050489 filed on Jul. 3, 2007 which designates the United States and claims priority from U.S. provisional patent application 60/818,527 filed on Jul. 6, 2006, the content of which is incorporated herein by reference.

FIELD OF THE INVENTION

The present invention relates to a method and an apparatus for controlling a flow of molten steel in a mould using a continuous slab casting machine, and a method for producing a slab using the flow control method and apparatus.

BACKGROUND OF THE INVENTION

One of the quality factors required for a cast product to be produced by a continuous slab casting machine is a reduced amount of inclusions entrapped in the surface layer of the cast product. Such inclusions to be entrapped in the cast product surface layer are, for example:

(1) deoxidation products occurring in a deoxidation step using aluminium and the like and suspending in molten steel;

(2) Argon gas bubbles blown into molten steel in a tundish or blown through an immersion nozzle; and (3) inclusions occurring with mould powder sprayed on a molten steel bath surface and entrained into the molten steel as suspending substances.

Any of these inclusions causes surface defects in steel products, so that it is important to reduce any kind of inclusions. By way of means for reducing, for example, deoxidation products and argon gas bubbles among the above described inclusions, there are popularly used processes of the type to prevent entrapment of inclusions in such a manner that intra mould molten steel is driven to move in the horizontal direction, and a molten steel velocity is thereby imparted to the surface of the molten steel to clean a solidifying surface. A practical process of applying a magnetic field for rotating the intra mould molten steel in the horizontal direction is carried out in such a manner that the magnetic field moving horizontally along the directions of long sides of the mould is driven to move in the directions opposite to each other along the opposing long side surfaces to induce a molten steel flow that behaves to rotate in the horizontal direction along the solidified surface. In this document, the application process is referred to different stirring modes, see various descriptions below, as "EMDC," "EMDC-mode," or "EMDC-mode magnetic field application" in combination with "EMLA," "EMLA-mode," "EMLA-mode magnetic field application" and/or "EMRS," "EMRS-mode," "EMRS-mode magnetic field application".

The EMDC, Electro Magnetic Direct Current, braking technology, with the stirrer in a low position in the mould, is by far the most dominant technology in general and it will therefore also be possible to fix the frequency down to zero and adjust the phase angle for highest magnetic flux density in the mould. DC technology has many advantages in general, such as stability and self-regulating, i.e. if the flow velocity is higher on one side, the braking force will also be higher. In comparison with very low frequency of 1 Hz or less, DC magnetic field in the lower part of the mould can give a more stable braking control of the fluid flow in the mould.

When operating in the Electromagnetic Level Accelerating mode, EMLA, with the stirrer in a low position in the mould, the outward flow speed of the steel, towards the narrow sides, is accelerated and thereby ensuring that a dual flow pattern is achieved also for low speed casting. The optimization of the flow in the mould involves the creation of a stable two-roll flow pattern. By choosing mode and the right FC MEMS, see description below, parameters, the requested flow-pattern can be achieved at different slab geometries and casting speeds. Instead of using the analytical F-value, this can be controlled by the FC MEMS with the use of a database containing relevant parameters for different operating conditions. These parameters are usually being generated by a numerical 3D-modelling package, EM Tool, which is modelling the magnetic field, fluid flow and temperature behaviour in the mould. When operating in EMLA mode the FC MEMS should be shifted to its lower position. For low casting speeds, the FC MEMS can accelerate the fluid flow towards the narrow face in order to assure a normal flow in the mould. The F-value is converted into the molten steel surface flow velocity. However, as described in EP-A-1486274, the F-value and the molten steel flow velocity have the one- to-one relationship, so that the control can be performed by using the F-value without conversion into the molten-steel surface flow velocity.

The slab mould stirrer type FC MEMS consists of one set of stirrers per mould. Each set of stirrers consists of four linear part stirrers. The two part stirrers on each side of the mould are built together into a stirrer unit in an outer casing, and are mounted in the existing pockets behind the backup plates in the wide side water jackets. Two opposite part stirrers are connected in series and are connected to one frequency converter. Totally two frequency converters are required for one mould, and the stirrer is designed and manufactured for continuous operation in the mould. The stirrer converts the low frequency currents from the frequency converter into a low frequency magnetic field, and said magnetic field penetrates the mould copper plates and the solidified shell of the strand and induces electrical currents in the liquid steel. These currents interact with the travelling magnetic field and create forces and thus movements in the liquid steel. The stirrer comprises windings and a laminated iron core. The stirrer windings are made of copper tubes with rectangular cross section and are directly cooled from the inside by de-ionized fine water circulating in a closed loop system. The stirrer is enclosed in a protective box with sides made from non-magnetic steel sheet and the front made from non-conductive material.

Electromagnetic Rotative Stirring mode, EMRS, which is the dominating technology for stirring in a mould takes place in the upper part of the mould close to the meniscus and the position of the stirrer is of vital importance for a controlled stirring of the fluid flow. For controlled and optimum stirring it is imperative to stir at a high position in the mould and the FC MEMS must therefore be shifted upwards. Stirring in a low position will conflict with the flow exiting the nozzle and give an uncertain and turbulent flow in the mould. It is therefore proposed that the stirrer is shifted upwards with when changing from EMLA-/EMDC-mode to stirring mode. The FC MEMS generates a rotational force on the steel in the mould. The frequency converter set up allows for a lower current to be applied on the two coils where the flow is directed towards the narrow sides and thereby giving the possibility to optimize the stirring parameters. The two frequency converters, however, need to be synchronised in frequency in order to minimize possible disturbance.

An example of a similar process as described above is described in European Patent Application 1486274 (JFE Engineering Corporation) in which a EMLS, Electromagnetic Level Stabilizer, is used in combination with EMLA and/or EMRS.

SUMMARY OF THE INVENTION

The present invention provides an improvement to a method and an apparatus for controlling a molten steel flow velocity on a molten steel bath surface, meniscus, in a mould to a predetermined molten steel flow velocity using a continuous slab casting machine, and a method for producing a slab using the flow control method and apparatus.

This is achieved by applying a static magnetic field to impart a stabilizing and braking force to a discharge flow from an immersion nozzle when the molten steel flow velocity on the meniscus is higher than the mould powder entrainment critical flow velocity and by controlling the molten steel flow velocity on the molten steel bath surface to a range of from an inclusion adherence critical flow velocity or more to a mould powder entrainment critical flow velocity or less by applying a shifting magnetic field to increase the molten steel flow when the molten steel flow velocity on the meniscus is lower than the inclusion adherence critical flow velocity.

When a molten steel flow velocity on a meniscus is higher than a mould powder entrainment critical flow velocity of 0.32 m/sec, the molten steel flow velocity is controlled to a predetermined molten steel flow velocity by applying a static magnetic field to stabilize and impart a braking force to a discharge flow from an immersion nozzle. When the molten steel flow velocity is lower than an inclusion adherence critical flow velocity of 0.20 m/sec and is higher than or equal to a bath surface skinning critical flow velocity of 0.10 m/sec, the molten steel flow velocity is controlled to the range of 0.20-0.32 m/sec by applying a shifting magnetic field to rotate the intra mold molten steel in a horizontal direction. When the molten steel flow velocity is lower than the inclusion adherence critical flow velocity, the molten steel flow velocity is controlled to the range of 0.20-0.32 m/sec by applying a shifting magnetic field to impart an accelerating force to the discharge flow from the immersion nozzle.

The FC MEMS will operate at different modes, e.g. EMLA, EMRS and EMDC, and the design of FC MEMS differs in several aspects from other stirring equipment:

The stirrer is designed for three phase current which eliminates one cable per phase compared to a two phase system. In case a three phase standard converter is used, the maximum phase current to the coil can also be minimized. A two phase system requires V2 larger phase current in the common return line. The standard converter system for stirrer applications has been modified and also includes the feature to have symmetry in the different phase currents. The higher symmetry achieved in the phase currents the higher performance can be achieved by the stirrer. A normal frequency converter will operate with common phase voltages and as the mutual inductances between the different windings differ, this will result in different phase currents;

The FC MEMS-design contains a coil capable of creating a static magnetic field for EMDC and a shifting magnetic field for EMLA and EMRS. The shifting magnetic fields for EMLA and EMRS are created by using polyphase AC-currents to feed the coil. Corresponding static magnetic fields will be created by feeding direct current in the different phases and by feeding with different current intensity in the different phases the distribution of the magnetic fields acting on the mould will differ and consequently the braking impact will also differ in different parts of the mould. It may be an advantage to vary the brake effect over time and consequently it is desirable to change the relationship between the DC-currents in the phases over time. Since the time for creating a certain flow pattern is at least 10 seconds, it is desirable to be able to vary the DC-current within said time;

The stirrer is designed for EMLA (accelerating mode) and EMRS (stirring mode). Rated current can be used at frequencies between 0.4-2 Hz. The stirrer is protected in a stainless steel casing and a slight over pressure of dry air is used for avoidance of moisture. The stirrer unit has double inlets and outlets for cooling water. One or the other set is used depending on stirrer position in the mould and the other is blocked.

BRIEF DESCRIPTION OF THE DRAWINGS

The present invention will be described in more detail in connection with the enclosed schematic drawings.

DETAILED DESCRIPTION OF THE INVENTION

Figure 1:
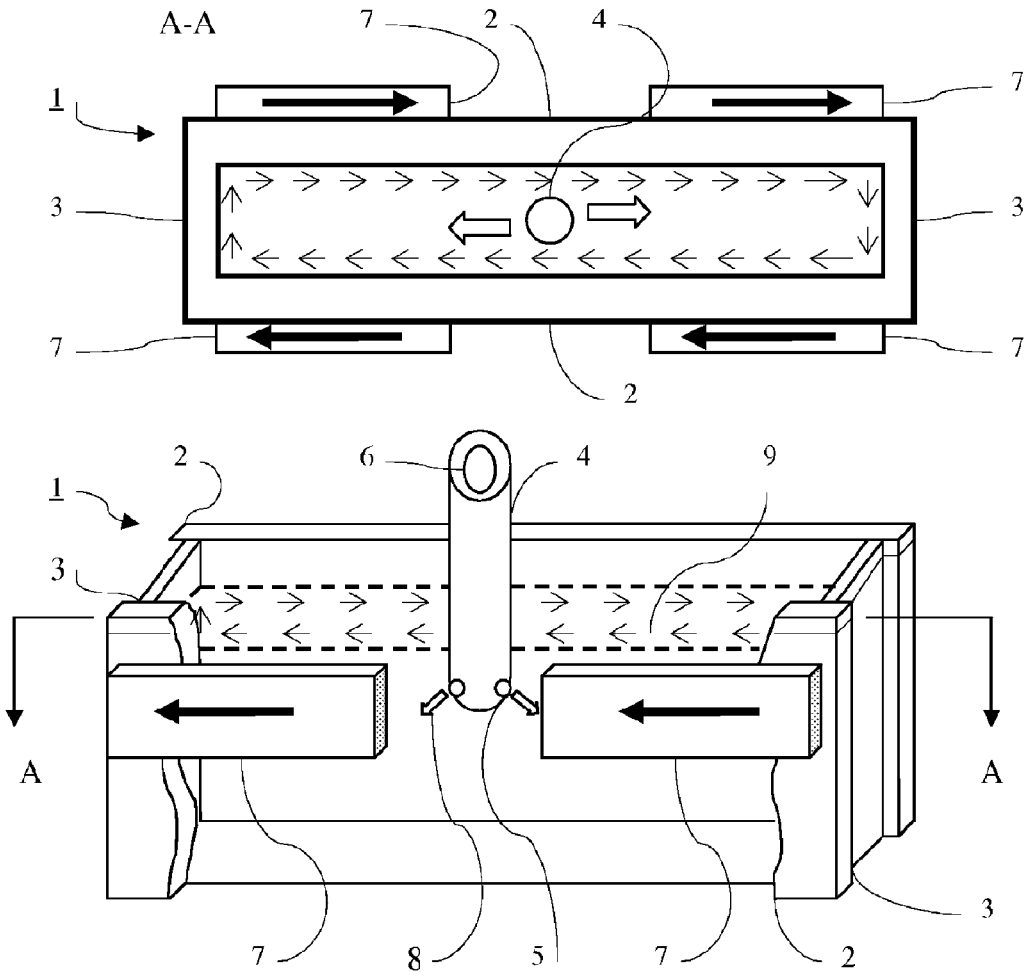
FIG. 1 is a schematic view of the continuous slab casting machine used when carrying out the present invention in an EMRS mode.
Figure 2:
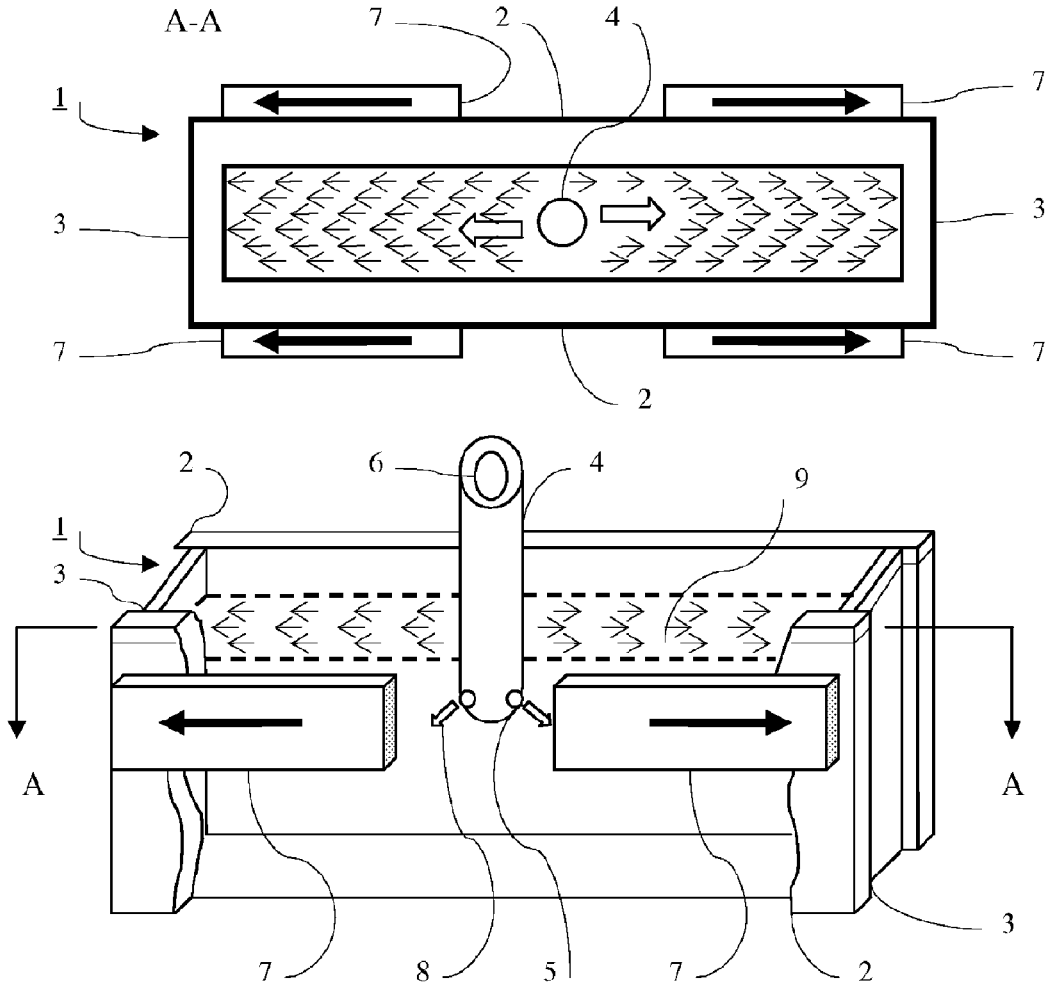
FIG. 2 is a schematic view of the continuous slab casting machine used when carrying out the present invention in an EMLA mode.
Figure 3:
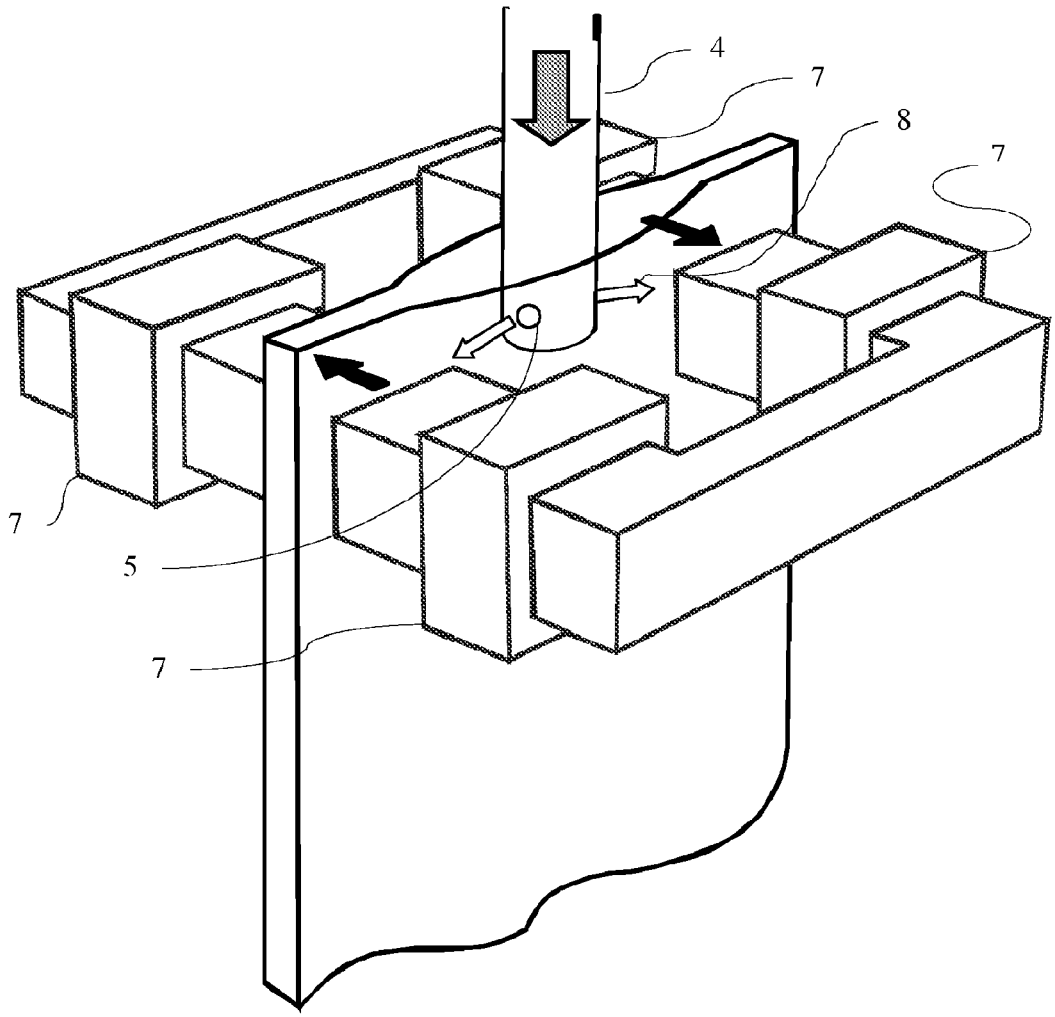
FIG. 3 is a schematic view of the continuous slab casting machine used when carrying out the present invention.

Embodiments of the present invention will be described herein below with reference to the accompanying drawings. FIGS. 1 and 2 are each schematic views of a continuous slab casting machine used when carrying out the present invention. More specifically, FIGS. 1 and 2 are both schematic perspective/front views of a mold portion according to the present invention.

Referring to FIG. 1 and 2, a tundish (not shown) is disposed in a predetermined position over a mold (1) that has mutually opposite mold long sides (2) and mutually opposite mold short sides (3) internally provided between the mold long sides (2) . An immersion nozzle (4) having a pair of discharge openings (5) in a lower portion is disposed in contact with an undersurface of a sliding nozzle (not shown) connected to the tundish. A molten steel outflow opening (6) is formed for the molten steel outflow from the tundish to the mold (1). On the rear surfaces of the mold long sides (2), four magnetic field generating apparatuses (7) in total are disposed in separation into two opposite sides in the left and right with respect to the immersion nozzle (4) as a boundary in the width direction of each of the mold long sides (2). The generators on the individual sides are thus disposed with the mold long sides (2) being interposed to have a center position in a casting direction thereof as an immediate downstream position of the discharge openings (5). The individual magnetic field generating apparatuses (7) are connected to a power supply (not shown) and the power supply is connected to a control unit (not shown) that controls the magnetic field movement direction and the magnetic field intensity. The magnetic field intensity and the magnetic field movement direction are independently controlled by electric power supplied from the power supply in accordance with the magnetic field movement direction and magnetic field intensity having been input from the control unit. The control unit is connected to a process control unit (not shown) that controls the continuous casting operation, whereby to control, for example, timing of magnetic field application in accordance with operation information sent from the process control unit.

In the event of EMRS-mode magnetic field application for inducing molten steel flow such as rotating in the horizontal direction on the solidifying surface, as shown in FIG. 1, the movement directions of the shifting magnetic field are set opposite to each other along the mold long sides (2) opposite to each other. In the event of EMLA-mode magnetic field application for imparting the accelerating force to the molten steel discharge flow (8) discharged from the immersion nozzle (4), as shown in FIG. 2, the movement directions of the magnetic field are set to the mold short sides (3) side from the immersion nozzle (4) side. According to FIG. 1, although the shifting field is set to a movement mode such as rotating clockwise, advantages are the same even when the magnetic field moves counterclockwise. Meanwhile, FIG. 1 and 2, respectively are views of the movement directions of the magnetic field being applied according to the EMRS and EMLA modes, as viewed from a position just above the mold (1), in which the arrows indicate the movement directions of the magnetic field.

In lower portions of the mold (1), there are situated a plurality of guide rolls (not shown) for supporting a cast product (not shown) that is to be produced by casting and a plurality of pinch rolls (not shown) for withdrawing the cast product.

Molten steel is poured from a pan (not shown) into a tundish (not shown) . When the molten steel amount reaches a predetermined amount, a slide plate (not shown) is opened to allow the molten steel to be poured into the mold (1) through the molten steel outflow opening (6) . The molten steel forms the molten steel discharge flow (8) proceeding to the mold short sides (3), and is then poured into the mold (1) from the discharge openings (5) immersed in the molten steel in the mold (1). The molten steel poured into the mold (1) is cooled by the mold (1), thereby forming a solidifying shell (not shown). When a predetermined amount of the molten steel has been poured into the mold (1), the operation starts withdrawal of the cast product (not shown) containing unsolidified molten steel in its inside with an outer shell as the solidifying shell. After the withdrawal is started, while the position of the molten steel meniscus (9) is being controlled to a substantially constant position in the mold (1), and the casting speed is increased to a predetermined casting speed. A mold powder is then added to the meniscus (9) in the mold (1). The mold powder is melted, thereby exhibiting the effect of, for example, preventing oxidation of the molten steel. Concurrently, the molten mold powder flows between the solidifying shell and the mold (1) and thereby exhibits an effect as a lubricant. In the casting operation, the molten steel flow velocities in the mold (1) short side (3) vicinity on the meniscus (9) are determined corresponding to the individual casting conditions.

One of the methods for determining the molten steel flow velocity is of a type that predicts the molten steel flow velocity on the meniscus (9) by using known equations in accordance with the each individual casting condition.

Another method is of a type that actually measures the molten steel flow velocity on the meniscus (9). When a casting condition has been determined and set, the molten steel flow velocity on the meniscus (9) is substantially constant under that condition. As such, when molten steel flow velocities in the meniscus (9) under the individual casting conditions are preliminarily measured, the flow velocity can be determined from the corresponding casting condition. In this case, the actual measurement value of the molten steel flow velocity may be preserved, and the preserved actual measurement value of the molten steel flow velocity may be determined as the molten steel flow velocity. The molten steel flow velocity can be measured in such a manner that a thin rod of a refractory material is immersed in the meniscus (9), and the flow velocity can be measured form kinetic energy received by the thin rod.

In the event that the molten steel flow velocity in the mold (1) short side (3) vicinity on the meniscus (9) is lower than or equal to the inclusion adherence critical flow velocity, more specifically, lower than 0.20 m/sec, the shifting magnetic field is applied according to the EMRS or EMLA mode. In the event that the molten steel flow velocity in the mold short side vicinity on the molten steel meniscus (9) is higher than the mold powder entrainment critical flow velocity, more specifically, higher than 0.32 m/sec, the static magnetic field is applied according to the EMDC mode .

Further, in the event that the molten steel flow velocity in the mold short side vicinity on the meniscus (9) is less than the inclusion adherence critical flow velocity, the application process for the shifting magnetic field is separated into two sub processes.

In the event that the above described molten steel flow velocity is less than the meniscus skinning critical flow velocity, more specifically, lower than 0.10 m/sec, the shifting magnetic field is preferably applied according to the EMLA mode.

In the event that the above described molten steel flow velocity is less than the inclusion adherence critical flow velocity and concurrently higher than or equal to the meniscus (9) skinning critical flow velocity, more specifically, 0.10 m/sec or higher and lower than 0.20 m/sec, the shifting magnetic field is preferably applied according to the EMRS mode.

In the manner described above, by continuously casting the molten steel while controlling the molten steel flow in the mold (2), the cast product, a clean, high quality cast product can be steadily produced by casting even over a wide range of casting speeds not only with very small amounts of substances such as deoxidation products and Argon gas bubbles but also with a very small amount of entrainment of the mold powder. The present invention is not limited to the embodiments disclosed but may be varied and modified within the scope of the following claims.

What is claimed is:

1. A method for controlling a flow of molten steel in a mould by applying at least one magnetic field to the molten steel in a continuous slab casting machine, the method comprising the steps of:

determining a molten steel flow velocity on the meniscus of the molten steel in the mould;

determining whether the determined molten steel flow velocity is higher than a mould powder entrainment critical flow velocity;

determining whether the molten steel flow velocity is lower than an inclusion adherence critical flow velocity by comparing the determined molten steel flow velocity with the mould powder entrainment critical flow velocity and the inclusion adherence critical flow velocity;

applying a static magnetic field to impart a stabilizing and braking force to a discharge flow from an immersion nozzle when the molten steel flow velocity on the meniscus is higher than the mould powder entrainment critical flow velocity; and applying a shifting magnetic field to the flow from the immersion nozzle to increase the molten steel flow when the molten steel flow velocity on the meniscus is lower than the inclusion adherence critical flow velocity, so that the flow velocity on the meniscus is controlled to a range between the inclusion adherence critical flow velocity and the mould powder entrainment critical flow velocity.

2. The method of claim 1, characterized in that the mould powder entrainment critical flow velocity is 0.32 m/sec and the inclusion adherence critical flow velocity is 0.20 m/sec.

3. A method of claim 1, characterized by that the static magnetic field has different configurations and can be time wise shifted between these configurations with a hold time of each configuration of minimum 10 seconds.

4. A method for producing a cast product in a continuous casting machine, characterized in that while a molten steel flow control is being executed in accordance with the method for controlling a flow of a molten steel as defined in claim 1, molten steel in a tundish is poured into a mould, and a slab is manufactured by withdrawing a solidified shell generated in the mould.

5. A method for controlling a flow of molten steel in a mould by applying at least one magnetic field to the molten steel in a continuous slab casting machine, the method comprising the steps of:

determining a molten steel flow velocity on the meniscus of the molten steel in the mould;

determining whether the determined molten steel flow velocity is higher than a mould powder entrainment critical flow velocity;

determining whether the molten steel flow velocity is lower than an inclusion adherence critical flow velocity by comparing the determined molten steel flow velocity with the mould powder entrainment critical flow velocity and the inclusion adherence critical flow velocity;

applying a static magnetic field to impart a stabilizing and braking force to a discharge flow from an immersion nozzle when the molten steel flow velocity on the meniscus is higher than the mould powder entrainment critical flow velocity; and applying a shifting magnetic field to the flow from the immersion nozzle to rotate the molten steel in a horizontal direction when the molten steel flow velocity on the molten steel bath surface is lower than the inclusion-adherence critical flow velocity, so that the flow velocity on the meniscus is controlled to a range between the inclusion adherence critical flow velocity and the mould powder entrainment critical flow velocity.

6. A method for controlling a flow of molten steel in a mould by applying at least one magnetic field to the molten steel in a continuous slab casting machine, the method comprising the steps of:

determining a molten steel flow velocity on the meniscus of the molten steel in the mould;

determining whether the determined molten steel flow velocity is higher than a mould powder entrainment critical flow velocity;

determining whether the molten steel flow velocity is lower than an inclusion adherence critical flow velocity by comparing the determined molten steel flow velocity with the mould powder entrainment critical flow velocity and the inclusion adherence critical flow velocity;

applying a static magnetic field to impart a stabilizing and braking force to a discharge flow from an immersion nozzle when the molten steel flow velocity on the meniscus is higher than the mould powder entrainment critical flow velocity; and applying a shifting magnetic field to the flow from the immersion nozzle to impart an accelerating force to the discharge flow from the immersion nozzle when the molten steel flow velocity on the meniscus is lower than the inclusion adherence critical flow velocity, so that the flow velocity on the meniscus is controlled to a range between the inclusion adherence critical flow velocity and the mould powder entrainment critical flow velocity.

7. A method for controlling a flow of molten steel in a mould by applying at least one magnetic field to the molten steel in a continuous slab casting machine, the method comprising the steps of:

determining a molten steel flow velocity on the meniscus of the molten steel in the mould;

determining whether the determined molten steel flow velocity is higher than a mould powder entrainment critical flow velocity;

determining whether the molten steel flow velocity is lower than an inclusion adherence critical flow velocity by comparing the determined molten steel flow velocity with the mould powder entrainment critical flow velocity and the inclusion adherence critical flow velocity;

applying a static magnetic field to impart a stabilizing and braking force to a discharge flow from an immersion nozzle when the molten steel flow velocity on the meniscus is higher than the mould powder entrainment critical flow velocity;

applying a shifting magnetic field to the flow from the immersion nozzle to rotate the molten steel in a horizontal direction when the molten steel flow velocity on the meniscus is lower than the inclusion adherence critical flow velocity and a bath surface skinning critical flow velocity or more; and applying a shifting magnetic field to the flow from the immersion nozzle to impart an accelerating force to the discharge flow from the immersion nozzle when the molten steel flow velocity on the meniscus is lower than the meniscus skinning critical flow velocity, so that the flow velocity on the meniscus is controlled to a range between the inclusion adherence critical flow velocity and the mould powder entrainment critical flow velocity.

8. The method of claim 7, characterized in that the mould powder entrainment critical flow velocity is 0.32 m/sec, the inclusion adherence critical flow velocity is 0.20 m/sec, and the meniscus skinning critical flow velocity is 0.10 m/sec.

9. A method for controlling a flow of molten steel in a mould by applying at least one magnetic field to the molten steel in a continuous slab casting machine, the method comprising the steps of:

determining a molten steel flow velocity on the meniscus of the molten steel in the mould;

determining whether the determined molten steel flow velocity is higher than a mould powder entrainment critical flow velocity;

determining whether the molten steel flow velocity is lower than an inclusion adherence critical flow velocity by comparing the determined molten steel flow velocity with the mould powder entrainment critical flow velocity and the inclusion adherence critical flow velocity;

applying a static magnetic field to impart a stabilizing and braking force to a discharge flow from an immersion nozzle when the molten steel flow velocity on a molten steel bath surface, meniscus, is higher than an optimal flow velocity value at which mould powder entrainment is minimized and inclusion adherence to a solidifying shell is minimized; and applying a shifting magnetic field to the flow from the immersion nozzle to rotate the molten steel in a horizontal direction when the molten steel flow velocity on the meniscus is lower than the optimal flow velocity value, so that the flow velocity on the meniscus is controlled to a range between the inclusion adherence critical flow velocity and the mould powder entrainment critical flow velocity.

10. The method of claim 9, characterized in that the optimal flow velocity value is 0.25 m/sec.

11. A method for controlling a flow of molten steel in a mould by applying at least one magnetic field to the molten steel in a continuous slab casting machine, the method comprising the steps of:

determining a molten steel flow velocity on the meniscus of the molten steel in the mould;

determining whether the determined molten steel flow velocity is higher than a mould powder entrainment critical flow velocity;

determining whether the molten steel flow velocity is lower than an inclusion adherence critical flow velocity by comparing the determined molten steel flow velocity with the mould powder entrainment critical flow velocity and the inclusion adherence critical flow velocity;

applying a static magnetic field to impart a stabilizing and braking force to a discharge flow from an immersion nozzle when a molten steel flow velocity on a molten steel bath surface, meniscus, is higher than an optimal flow velocity value at which mould powder entrainment is minimized and inclusion adherence to a solidifying shell is minimized; and applying a shifting magnetic field to the flow from the immersion nozzle to impart an accelerating force to the discharge flow from the immersion nozzle when the molten steel flow velocity on the meniscus is lower than the optimal flow velocity value, so that the flow velocity on the meniscus is controlled to a range between the inclusion adherence critical flow velocity and the mould powder entrainment critical flow velocity.

12. A method for controlling a flow of molten steel by applying at least one magnetic field to the molten steel in a continuous slab casting machine, the method being the method comprising the steps of:

determining a molten steel flow velocity on the meniscus of the molten steel in the mould;

determining whether the determined molten steel flow velocity is higher than a mould powder entrainment critical flow velocity;

determining whether the molten steel flow velocity is lower than an inclusion adherence critical flow velocity by comparing the determined molten steel flow velocity with the mould powder entrainment critical flow velocity and the inclusion adherence critical flow velocity;

applying a static magnetic field to the flow from the immersion nozzle to impart a stabilizing and braking force to a discharge flow from an immersion nozzle when the molten steel flow velocity on a molten steel bath surface, meniscus, is higher than an optimal flow velocity value at which mould powder entrainment is minimized and inclusion adherence to a solidifying shell is minimized;

applying a shifting magnetic field to the flow from the immersion nozzle to rotate the molten steel in a horizontal direction when the molten steel flow velocity on the meniscus is lower than the optimal flow velocity value and is higher than or equal to a bath surface skinning critical flow velocity; and applying the molten steel flow velocity on the meniscus to impart an accelerating force to the discharge flow from the immersion nozzle when the molten steel flow velocity on the meniscus is lower than the bath surface skinning critical flow velocity, so that the flow velocity on the meniscus is controlled to a range between the inclusion adherence critical flow velocity and the mould powder entrainment critical flow velocity.

13. The method of claim 12, characterized in that the optimal flow velocity value is 0.25 m/sec, and the bath surface skinning critical flow velocity is 0.10 m/sec.

14. A method for controlling a flow of molten steel in a mould, the method comprising the steps of:

a first step of acquiring at least one condition as casting condition on a cast product thickness, a cast product width, a casting speed, an amount of inert gas injection into a molten steel outflow opening nozzle, and an immersion nozzle shape;

a second step of calculating a molten steel flow velocity on a molten steel bath surface in accordance with the acquired casting conditions;

a third step of determining whether the acquired molten steel flow velocity is higher than a mould powder entrainment critical flow velocity and whether the molten steel flow velocity is lower than an inclusion adherence critical flow velocity by comparing the acquired molten steel flow velocity with the mould powder entrainment critical flow velocity and the inclusion adherence critical flow velocity; and a fourth step of applying a static magnetic field to impart a stabilizing and braking force to a discharge flow from an immersion nozzle when the acquired molten steel flow velocity is higher than the mould powder entrainment critical flow velocity, and applying a shifting magnetic field to rotate the molten steel in a horizontal direction when the acquired molten steel flow velocity is lower than the inclusion adherence critical flow velocity, wherein the flow of the molten steel is controlled by applying a predetermined shifting magnetic field to the molten steel in a continuous slab casting machine, so that the flow velocity is controlled to a range between the inclusion adherence critical flow velocity and the mould powder entrainment critical flow velocity.

15. The method of claim 14, characterized in that the first to fourth steps are repeatedly executed during casting, and an optimal shifting magnetic field is applied in response to casting conditions during the execution.

16. A method for controlling a flow of molten steel in a mould, the method comprising the steps of:

a first step of acquiring at least one condition as casting condition on a cast product thickness, a cast product width, a casting speed, an amount of inert gas injection into a molten steel outflow opening nozzle, and an immersion nozzle shape;

a second step of calculating a molten steel flow velocity on a molten steel bath surface in accordance with the acquired casting conditions;

a third step of determining whether the acquired molten steel flow velocity is higher than a mould powder entrainment critical flow velocity, whether the molten steel flow velocity is lower than an inclusion adherence critical flow velocity, and whether the molten steel flow velocity is lower than a bath surface skinning critical flow velocity by comparing the acquired molten steel flow velocity with the mould powder entrainment critical flow velocity, the inclusion adherence critical flow velocity, and the bath surface skinning critical flow velocity; and a fourth step of applying a static magnetic field to impart a stabilizing and braking force to a discharge flow from an immersion nozzle when the acquired molten steel flow velocity is higher than the mould powder entrainment critical flow velocity, and applying a shifting magnetic field to rotate the intra mould molten steel in a horizontal direction when the acquired molten steel flow velocity is lower than the inclusion adherence critical flow velocity and is higher than or equal to the bath surface skinning critical flow velocity, and applying a shifting magnetic field to impart an accelerating force to a discharge flow from an immersion nozzle, wherein the flow of the molten steel is controlled by applying a predetermined shifting magnetic field to the molten steel in a continuous slab casting machine, so that the flow velocity is controlled to a range between the inclusion adherence critical flow velocity and the mould powder entrainment critical flow velocity.

17. An apparatus for controlling a flow of molten steel in a mould by applying at least one magnetic field to the molten steel in a continuous slab casting machine, the apparatus comprising:

casting-condition acquiring means for acquiring at least one condition as casting condition on a cast product thickness, a cast product width, a casting speed, an amount of inert gas injection into a molten steel outflow opening nozzle, and an immersion nozzle shape;

calculating means for calculating a molten steel flow velocity on a molten steel bath surface in accordance with the acquired casting conditions;

determining means for determining whether the acquired molten steel flow velocity is higher than a mould powder entrainment critical flow velocity and whether the molten steel flow velocity is lower than an inclusion adherence critical flow velocity by comparing the acquired molten steel flow velocity with the mould powder entrainment critical flow velocity and the inclusion adherence critical flow velocity;

control means for applying a static magnetic field to impart a stabilizing and braking force to a discharge flow from an immersion nozzle when the determined molten steel flow velocity is higher than the mould powder entrainment critical flow velocity, and applying a shifting magnetic field to the immersion nozzle to rotate the molten steel in a horizontal direction when the acquired molten steel flow velocity is lower than the inclusion adherence critical flow velocity; and means for generating a magnetic field, including a coil capable of creating a static magnetic field and a shifting magnetic field, in the vicinity of the discharge flow from the immersion nozzle in accordance with an output from the control means.

18. An apparatus for controlling a flow of molten steel in a mould by applying at least one magnetic field to the molten steel in a continuous slab casting machine, the apparatus comprising:

casting-condition acquiring means for acquiring at least one condition as casting condition on a cast product thickness, a cast product width, a casting speed, an amount of inert gas injection into a molten steel outflow opening nozzle, and an immersion nozzle shape;

calculating means for calculating a molten steel flow velocity on a molten steel bath surface, meniscus, in accordance with the acquired casting conditions;

determining means for determining whether the acquired molten steel flow velocity is higher than a mould powder entrainment critical flow velocity, whether the molten steel flow velocity is lower than an inclusion adherence critical flow velocity, and whether the molten steel flow velocity is lower than the meniscus skinning critical flow velocity by comparing the acquired molten steel flow velocity with the mould powder entrainment critical flow velocity, the inclusion adherence critical flow velocity, and the meniscus skinning critical flow velocity;

control means for applying a static magnetic field to impart a stabilizing and braking force to a discharge flow from an immersion nozzle when the determined molten steel flow velocity is higher than the mould powder entrainment critical flow velocity, applying a shifting magnetic field to rotate the molten steel in a horizontal direction when the acquired molten steel flow velocity is lower than the inclusion adherence critical flow velocity and is higher than or equal to the meniscus skinning critical flow velocity, and applying a shifting magnetic field to the immersion nozzle to impart an accelerating force to the discharge flow from the immersion nozzle when the acquired molten steel flow velocity is lower than the meniscus skinning critical flow velocity; and means for generating a magnetic field, including a coil capable of creating a static magnetic field and a shifting magnetic field, in the vicinity of the discharge flow from the immersion nozzle in accordance with an output from the control means.

* * * * *